United States Patent [19]

Riddell et al.

[11] Patent Number: 4,569,312

[45] Date of Patent: Feb. 11, 1986

[54] HOT WATER TANK WARNING SYSTEM

[76] Inventors: George Riddell, 7776 Clover Field Cir., Boca Raton, Fla. 33433; Edward J. Grispino, 22263 Morning Glory Ter., Boca Raton, Fla. 33432

[21] Appl. No.: 579,450

[22] Filed: Feb. 13, 1984

[51] Int. Cl.[4] ..... F22B 37/42; G08B 21/00

[52] U.S. Cl. ..... 122/504.2; 137/558; 165/70; 236/94; 340/616

[58] Field of Search ..... 236/94, 92 C; 165/70, 165/11 R; 137/558; 340/616; 116/110; 126/374, 383; 122/504.2

[56] References Cited

U.S. PATENT DOCUMENTS

| | | | |
|---|---|---|---|
| 2,142,927 | 1/1939 | Walker | 340/616 X |
| 2,740,586 | 4/1956 | Chaniot | 236/94 X |
| 3,069,671 | 12/1962 | Taylor | 340/616 |
| 3,857,358 | 12/1974 | Ward et al. | 137/558 X |
| 4,392,128 | 7/1983 | Young | 137/558 X |
| 4,418,712 | 12/1983 | Braley | 137/558 |

*Primary Examiner*—William E. Wayner

*Attorney, Agent, or Firm*—Eugene F. Malin

[57] ABSTRACT

An electrical overflow warning system for a hot water tank. There is provided a cavity within an overflow line leading from the tank. Within the cavity is located an electrical probe. When an overflow occurs the probe comes in contact with water causing an electrical circuit to be completed to an alarm.

11 Claims, 5 Drawing Figures

HOT WATER TANK WARNING SYSTEM

BACKGROUND OF THE INVENTION

This invention relates to a hot water tank early warning system primarily for use in the temperature/pressure overflow sections of hot water heater tank systems. The alarm indicating system sensing even small amounts of water in the overflow system, whether it is due to excessive water temperature, water pressure, or deteriorating conditions in the temperature/pressure valve.

The early warning system brings attention to the failing condition almost immediately, long before it can be detected by presently available means in the marketplace. The early warning device can save considerable energy and water.

The present invention provides a means for using an electrical sensor in the early warning system, positioned adjacent to and downstream of the temperature/pressure valves located in the area of the hot water tank overflow system. The early warning system is constructed and arranged to allow a small pool of water to form quickly in the event of any water leaking into the overflow system. The electrical sensor is bridged under this condition and causes an electronic timing circuit to control by a signal an audible and/or visual indicator to sound and/or flash an early warning. This early warning feature can be used in other types of systems in which fluids other than water is being monitored.

SUMMARY OF THE INVENTION

This invention generally relates to hot water heater tank systems, both commercial and private, in which overflow system features are means to avoid catastrophic and dangerous water tank failures due to excessive temperature and/or pressure. The invention, a hot water tank alarm indicating system particularly relates to that part of the hot water heater system connected to the temperature/pressure (T/P) valve which allows overflow water to be exhausted into drainage arrangements for disposal of hot water passing through the temperature/pressure valve. This invention allows early detection of water collecting or passing through the system and gives an alarm so that corrective measures can be quickly taken. In recent years the increasing unavailability of potable water and increasing cost of electricity or gas or other fuels to heat hot water makes it highly desireable to provide such early detection methods.

In present hot water heating systems the temperature/pressure valve can allow water to enter the overflow system for several reasons. The hot water tank warning system includes an early warning device and an electronic sensor means connected to said device for providing an early warning. The system is connected to the hot water overflow system downstream from the hot water tank and the temperature/pressure overflow valve. The device includes a container portion capturing fluid moving out through the overflow pipe. The electronic sensor means includes a sensor having a bulb in the container portion. The sensor is connected to the circuit by electric lead and the overflow system is placed in the sensor circuit by electric lead. When the water 24 closes the circuit the electric circuit is activated to provide an audio alarm 36 or a light indication.

Failure of the thermostat to adequately control the temperature of the water can cause the temperature/pressure valve to function and pass water into the overflow system until the temperature of the water drops. A very considerable volume of water could be passed through the overflow system before this occurs. In addition there is considerable amount of energy consumed to heat the exiting water and to heat the replacing water coming into the tank. This failure could go undetected for considerable time with large economic penalties. This is especially true if the overflow system empties directly into a sewer system or is dispensed directly into the ground through a common drain pipe.

Operations of the pressure detecting features of the temperature/pressure valves can occur if water pressure from the source of supply is allowed to go too high, or if the temperature/pressure valve itself loses its adjustment due to deteriorating conditions in the spring adjustments. The overflow can go undetected for a long time if water overflow is diverted into some water disposal system and wastes water and energy resulting in economic penalties.

It is obvious therefore that the early detection features provided by this invention can alarm dangerous temperature and pressure conditions in the hot water heaters and avoid heavy economic penalties when these conditions are not quickly detected.

DETAILED DESCRIPTION OF THE PREFERRED EMBODIMENT

Figure 1:
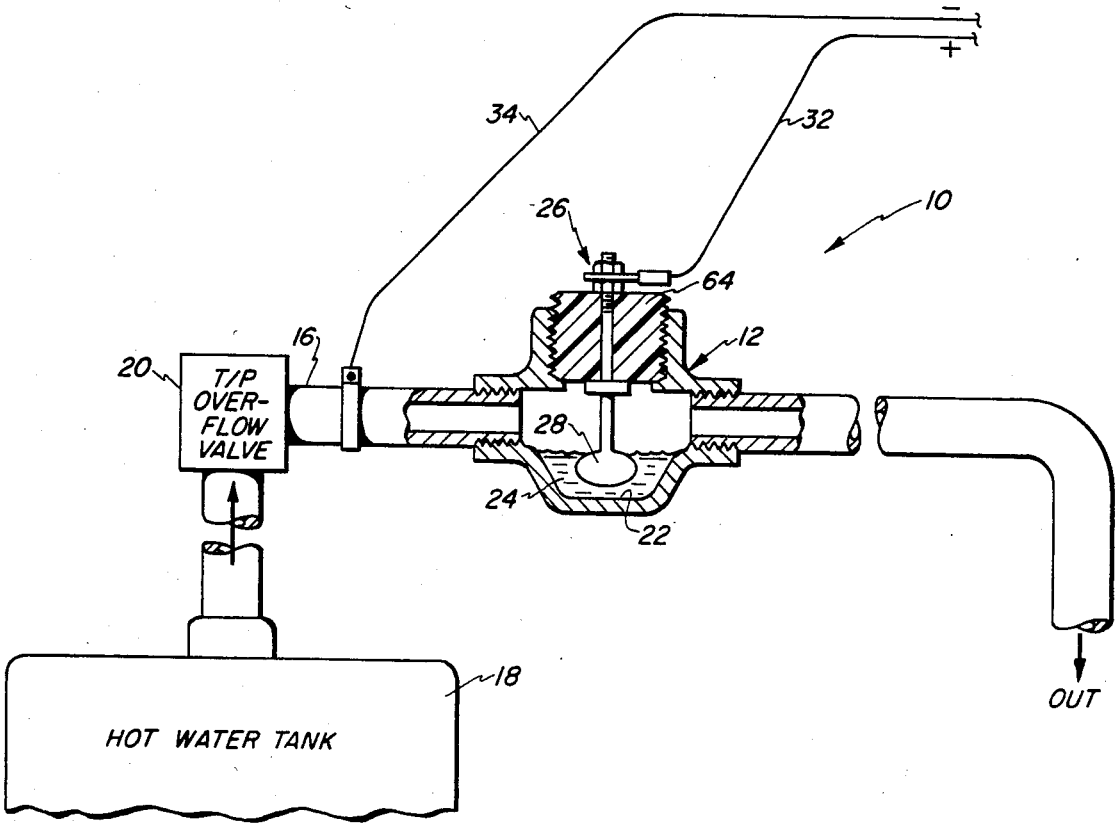
FIG. 1 is an illustration of the warning system connected to a hot water system.
Figure 2:
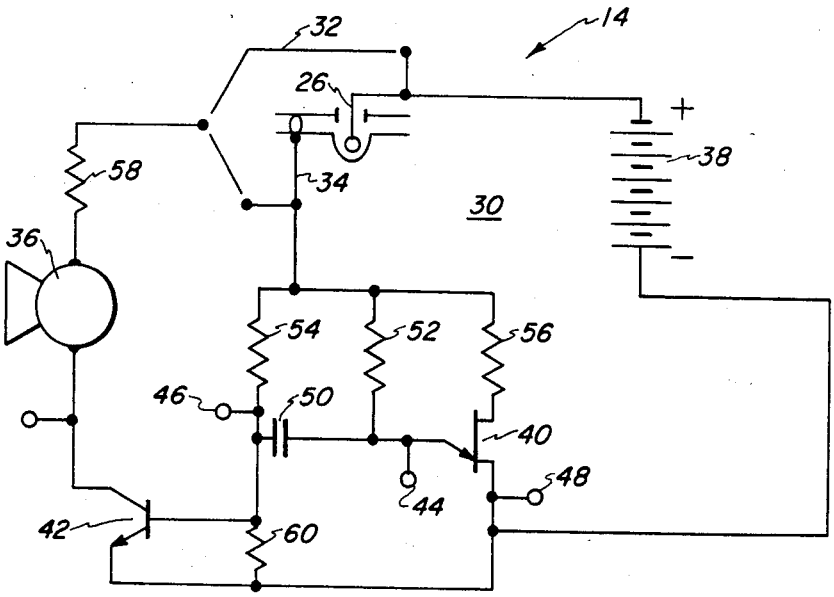
FIG. 2 is an electronic sensor means and circuit.

Referring now to FIGS. 1 and 2 in detail, the structure of the hot water tank warning system 10 includes an early warning device 12 and an electronic sensor means 14 connected to said device for providing an early warning. The system 10 is connected to the hot water overflow system 16 downstream from the hot water tank 18 and the temperature/pressure overflow valve 20. The device 12 includes a container portion 22 capturing fluid 24 moving out through the overflow pipe. The electronic sensor means 14 includes sensor 26 having a bulb 28 in the container portion. The sensor 26 is connected to the circuit 30 by electric lead 32 and the overflow system 16 is placed in the sensor circuit by electric lead 34. When the water 24 closes the circuit the electric circuit 30 is activated to provide an audio alarm 36 or a light indication.

Referring to FIG. 1 the basic operation of the system is centered on the electrical sensor 28 arranged as shown. Any water 24 leaking through the temperature/pressure valve 20 quickly fills up the depressed area or container portion 22 forming a conducting path from the sensor rod bulb 28 to the inside surface of the device 12, a metallic T-fitting. This high resistance conducting path forms very quickly and will continue as long as the small depressed area or container port in 22 contains the water 24.

Associated with the sensor device is an electronic alarm circuit 30 shown in FIG. 2. In operation the alarm circuit functions as follows. The circuit normally resides in a "stand-by" mode, monitoring the sensor device to determine that there is an "open circuit" condition which is the case when there is no water in the container portion 22 of the "T-fitting". In this stand-by mode the alarm circuit uses essentially no power as the power source 38 to the alarm unit is in series with the sensor rod device. This arrangement guarantees very long battery life in the stand-by mode.

The alarm circuit 30 itself consists of a "PN" unijunction transistor 40 relaxation oscillator circuit driving an "NPN" transistor 42 for increased circuit sensitivity. This NPN transistor 42 controls the application of power to a Piezo Electric buzzer 36 which gives an audible alarm when the circuit becomes activated.

In the stand-by mode there is no voltage applied to the circuit 30 and points 44, 46 and 48 are at the same voltage level and no electric current flows through the piezo buzzer 36 or the transistors 40 or 42. There is no voltage potential across capacitor 50. When a circuit is established through the sensor rod 26 the voltage at points 44 and 46 rises to a potential which causes transistor 42 to activate thereby allowing current to flow through the piezo buzzer 36 immediately sounding an audible alarm. The voltage at point 44 starts rising higher in voltage as capacitor 50 is charged by current through 52. As the voltage at point 44 rises to a particular value called the "Peak Point" the unijunction transistor goes into a "negative resistance" region for a short period of time passing heavy currents thus causing the voltage at point 44 to drop precipitously. After this momentry condition the unijunction transistor goes back to a high internal resistance condition between points 44 and 48. The drop in voltage at point 44 is immediately reflected by a similar drop in voltage at point 46 through capacitor 50. This drop in voltage causes transistor 42 to deactivate and shut off the piezo buzzer 36. As there is still voltage applied to the circuit, 54 starts charging capacitor 50 and increasing the voltage at point 46. When the voltage at point 46 becomes positive with respect to point 48 by about 0.74 V transistor 42 is reactivated and the alarm sounds again. Operation of transistor 42 maintains the voltage at point 46 to approximately 0.75 volts. As the unijunction transistor has returned to a high resistance condition between points 44 and 48, resistor 52 starts increasing the voltage at point 44 as capacitor 50 charges from the current through resistor 52. When the voltage at point 44 rises to the peak voltage point causing the unijunction transistor to enter its negative resistance region the cycle repeats causing the piezo buzzer 36 to turn off.

The intervals of time in which the buzzer sounds and the intervals it is silent are determined by the resistance values of 52 and 54, capacitor 50, and the characteristic of the active transistor devices 40 and 42. Detailed information of operation of unijunction transistor circuits can be obtained in technical literature. Reference—Electronic Devices and Circuit Theory, Prentice Hall by Boylestad/Nashley, pages 439 through 444.

Resistor 58 controls the loudness of the piezo buzzer 36 and also reduces power consumption in the alarm condition. Resistor 56 is used to adjust the operating range of the unijunction transistor. Resistor 60 is used to help stabilize the circuitry.

For the purpose of this invention the values of circuit components picked were used to sound approximately one half second audible sound with a silent period of one half second between beeps. The values also reflect a very low power consumption during the alarm condition of about twenty milliwatts.

Other alarm circuit arrangements could be used to perform the same objective using digital devices or other means. However this arrangement uses extremely low power and was determined to be well adapted to this alarm device which must stay in the stand-by monitoring mode for long periods of time. It is also particularly good for its low power drain in the alarm mode. The reliability of unijunction devices in relaxation oscillator circuits is well known and it was therefore chosen for use in this invention. This does not mean that other electronic circuitry could not be used for this purpose.

Concerning the sensor devices, there are several ways this could be implemented although FIGS. 1 and 2 present only one sensor arrangement. An integrated alarm arrangement in which the sensor circuit and alarm shown in figure may be mounted as a unit on the device 12 on the overflow pipes.

Figure 3:
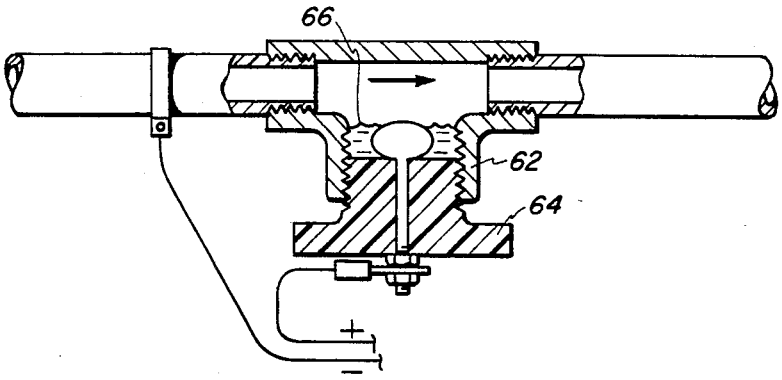
FIG. 3 is a T illustration showing the sensor connected in the T with the top facing downward.

FIG. 3 shows a T-fitting with the out-of-line opening positioned downward at 62. The non-conductive plug 64 as shown in FIG. 1 is only partially inserted into the opening forming a container portion 66. The alarm unit is mounted as in FIG. 2.

Figure 4:
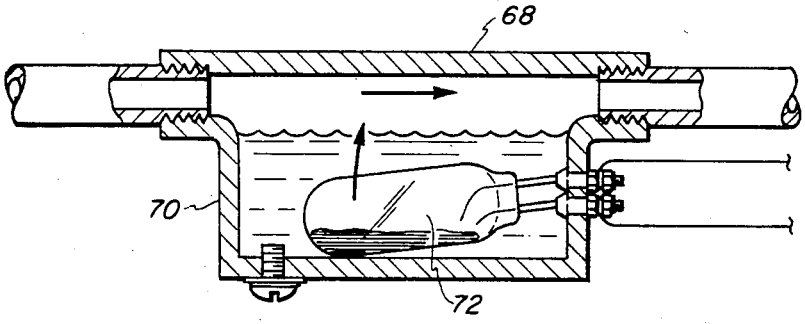
FIG. 4 is a chamber connection with mercury switch sensor.

FIG. 4 is an enlarged container 68 with container portion 70 buoyant mercury switch 72. When water fills the cavity the switch is activated to move up in the direction of the arrow from the position shown. The alarm is connected as shown in FIG. 2.

Figure 5:
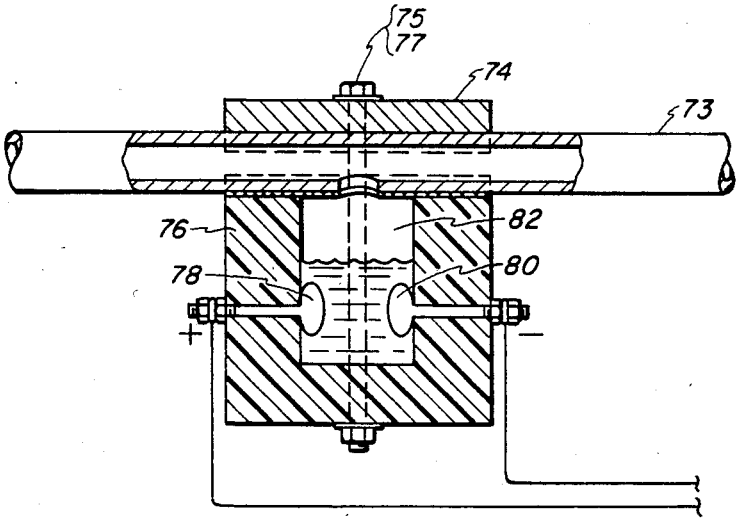
FIG. 5 is a side view partially in cross section of a minimum plumbing installation.

FIG. 5 allows one to drill a hole vertically through the pipe 73. An upper cap or cover means 74 is placed on top of the pipe over the hole not shown. A lower portion or lower cover means 76 with a cavity of non-conductive material portion 82 is placed on the bottom of the pipe. A gasket may be used between the pipe and lower cover means. The cap and lower portion 76 is bolted together by one or two bolts 75 and 77. The lower hole in the pipe allows the water to enter into the cavity portion 82. The sensor includes probe 78 and 80 that are electrically connected by water in the cavity portion 82.

It is also noted that with proper switching arrangements a multiple alarm system could be designed requiring only one alarm unit to monitor several sensors in commercial installations. These means are presently available for use.

We also note that although not shown here, methods of showing visual alarm indications, either combined with or instead of audible signals could be easily designed to supplement this invention. These means are well known to the art and need not be detailed.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A hot water tank warning system in an overflow conduit comprising:

a conduit member including an inlet and outlet connected in said overflow conduit for flow through of overflow water passing through said overflow conduit, said conduit member including a section defining a water cavity portion therein of such size to retain a small portion of any of said overflow water, a signal means connected to said conduit member, said signal means including, an open circuit means positioned within said water cavity portion, said open circuit means includes an open position and a closed position, said open circuit means for actuation to said closed position by said overflow water in said water cavity portion bridging said open circuit means, said signal means for providing a signal when overflow water is in said water cavity portion;

said conduit member is a fitting for a pipe, said open circuit means is a switch with two open terminals that are closed by overflow water, said signal means includes an alarm circuit connected to said open circuit means to indicate an early alarm, said cavity portion and said signal means being so constructed, arranged and associated with each other that said signal means functions to give an early alarm warning when said cavity portion includes only small amounts of water therein.

2. A hot water tank warning system in an overflow conduit comprising:

a conduit member including an inlet and outlet connected in said overflow conduit for flow through of overflow water passing through said overflow conduit, said conduit member including a water cavity portion therein to retain at least a portion of any of said overflow water, a signal means connected to said conduit member, said signal means including, an open circuit means positioned across said water cavity portion, said open circuit means includes an open position and a closed position, said open circuit means for actuation to said closed position by said overflow water in said water cavity portion bridging said open circuit means, said signal means for providing a signal when overflow water is in said water cavity portion;

said conduit member is a fitting for a pipe, said open circuit means is a switch with two open terminals that are closed by overflow water, said signal means includes an alarm circuit connected to said open circuit means to indicate an early alarm; wherein:

said fitting includes a cover means, another cover means including said water cavity portion, and a connector, said cover means for covering an upper hole in said overflow circuit, said cover means including said water cavity portion for covering a lower hole in said overflow circuit, said connector securing said fitting on said overflow conduit.

3. A system for annunciating blow-off of a liquid from a tank holding said liquid, said system comprising:

a means for transporting said blow-off of said liquid from said tank, said means being a blow-off pipe;

pipe means including a portion so shaped to retain at least a small portion of said blow-off in said pipe in the form of a puddle;

means associated with said pipe for annunciating said blow-off of said liquid, said means for annunciating effective to annunciate said blow-off responsive to the depth of said puddle exceeding a preselected vertical distance, said cavity portion and said signal means being so constructed, arranged and associated with each other that said signal means functions to give an early alarm warning when said cavity portion includes only small amounts of water therein.

4. The system of claim 3, wherein said pipe comprises a section, said section being a pipe fitting open at the opposite ends thereof, a portion of said means for annunciating being disposed within said small shaped portion of said fitting, said portion of said means for annunciating being effective to cause said means for annunciating to annunciate said blow-off responsive to said depth of said puddle exceeding said preselected vertical distance.

5. The system of claim 3, wherein said means for annunciating comprises at least one electrode, said electrode being disposed so that said puddle exceeding said preselected vertical distance is effective to cause an electrical short circuit to said at least one electrode, said means for annunciating being effective to annunciate said blow-off responsive to said short circuit.

6. The system of claim 5, wherein said means for annunciating is an electronic circuit adapted to annunciate said blow off continuously so long as said depth of said puddle exceeds said preselected vertical distance.

7. The system of claim 3, wherein said means for annunciating is an electronic circuit adapted to annunciate said blow off continuously so long as said depth of said puddle exceeds said preselected vertical distance.

8. A system for annunciating blow-off of a liquid from a tank holding said liquid, said system comprising:

a means for transporting said blow-off of said liquid from said tank, said means being a blow-off pipe comprising a section, said section being a pipe fitting comprising an inlet side means and an outlet side means, each said side means being for joining said fitting to said pipe effectively to permit passage of said liquid along said pipe and through said pipe fitting from said inlet side means to outlet side means;

said fitting comprising an additional opening and a cover, said cover being effective to seal said additional opening;

means for retaining at least a portion of said blow-off in said pipe in the form of a puddle; and means for annunciating said blow-off of said liquid, a portion of said means for annunciating penetrating said cover and being mounted by said cover, said means for annunciating being effective to annunciate said blow-up responsive to the depth of said puddle exceeding a preselected vertical distance.

9. The system of claim 6, wherein said means for annunciating comprises at least one electrode, said electrode being disposed so that said puddle exceeding said preselected vertical distance is effective to cause an electrical short circuit to said at least one electrode, said means for annunciating being effective to annunciate said blow-off responsive to said short circuit.

10. The system of claim 9, wherein said means for annunciating is an electronic circuit adapted to annunciate said blow off continuously so long as said depth of said puddle exceeds said preselected vertical distance.

11. The system of claim 8, wherein said means for annunciating is an electronic circuit adapted to annunciate said blow off continuously so long as said depth of said puddle exceeds said preselected vertical distance.

* * * * *